US005569046A

United States Patent [19]

Pfetzer

[11] Patent Number: 5,569,046

[45] Date of Patent: Oct. 29, 1996

[54] ELECTRICAL CONNECTION ARRANGEMENT

[75] Inventor: Johannes Pfetzer, Buehl, Germany

[73] Assignee: Robert Bosch GmbH, Stuttgart, Germany

[21] Appl. No.: 481,345

[22] PCT Filed: Nov. 24, 1994

[86] PCT No.: PCT/DE94/01387

§ 371 Date: Jun. 13, 1995

§ 102(e) Date: Jun. 13, 1995

[87] PCT Pub. No.: WO95/15019

PCT Pub. Date: Jun. 1, 1995

[30] Foreign Application Priority Data

Nov. 27, 1993 [DE] Germany ..... 43 40 638.6

[51] Int. Cl.[6] ..... H01R 4/24

[52] U.S. Cl. ..... 439/443; 439/434; 439/751

[58] Field of Search ..... 439/433, 434, 439/443, 783, 840, 751

[56] References Cited

U.S. PATENT DOCUMENTS 3,071,750 1/1963 Heselwood ..... 439/783

5,030,134 7/1991 Plösser ..... 439/434

*Primary Examiner*—David L. Pirlot
*Assistant Examiner*—Brian J. Biggi

[57] ABSTRACT

An electrical connection arrangement between a contact element (13) and connection wire (12)is designed in such a way that reliable contact-making is possible in a simple manner and with the capability of automation. For this purpose, the connecting arrangement has a receptacle (11), in which the connecting wire (12) is held in the form of a winding having a plurality of turns. The contact element (13) provided with cutting edges (32) can be plugged into the receptacle (11). The outer delimitations of the turns of the connecting wire (12) and the cutting edges (32) are inclined with respect to one another in their longitudinal extent, with the result that, in the case of a plug-in movement of the contact element (13) into the receptacle (11), said contact element enters into a cutting connection on a plurality of turns of the connecting wire (12). This connection arrangement is used, inter alia, when contact is made between the connecting wires (12) of coils.

8 Claims, 2 Drawing Sheets

ELECTRICAL CONNECTION ARRANGEMENT

BACKGROUND OF THE INVENTION

The invention relates to an electrical connection arrangement of for retention of a connecting wire. Such a connection arrangement has been disclosed by DE 41 40 227 A1 and relates to a device for connecting a cable end, which has been cut off perpendicularly with respect to its longitudinal axis, to a plug or socket element.

The latter has a clamping contact which penetrates the cable from the end side and is secured by means of a sleeve, which can be pushed over the cable end, and a union nut, which presses the cable end against a stop surface, the sleeve being pressed against the outer insulation of the cable.

As a result of its structure, this connection arrangement requires a high production outlay and, in addition, can be used only in the case of a cable whose conductors comprise a wire bundle, with the result that cables having a single wire in each case cannot be connected.

The production of connection arrangements by soldering or welding is also known. In the case of a cable whose conductor is formed by a single wire, this leads to poor production automation if the wire is insulated, since, depending on the type of insulation, thermal or mechanical insulation stripping is required, and the wire end also has to be tin-coated in the case of soldering.

SUMMARY OF THE INVENTION

Accordingly, it is an object of the present invention to provide an electrical connection arrangement which avoids the disadvantages of the prior art.

In keeping with these objects and with others which will become apparent hereinafter, one feature of the present invention resides, briefly stated, in an electrical connection arrangement having a receptacle for retention of a connecting wire and having a contact element for connection of the connecting wire and for the detachable coupling to a mating plug, wherein the connecting wire is arranged in form of a winding with a plurality of turns in a manner such that it can be brought to bear against the receptacle, the contact element with at least one cutting edge extending in a longitudinal direction of the winding, the cutting edge and the winding delimitation opposite the latter are inclined with respect to one another in the longitudinal direction of the winding due to the receptacle, and in the event of a plugging movement of the contact element onto or into the receptacle, the cutting edges enter into a cutting connection with at least one of the turns of the connecting wire which is radially supported on the delimitation.

In accordance with one new feature of the present invention, the contact element is formed as a flat-pin plug having two limbs with inner sides provided with cutting edges in a contact section, and the cutting edges are inclined with respect to the longitudinal axis of the contact element.

In accordance with another novel feature of the present invention, the receptacle is formed as a conical hole and the contact element is formed as a circular plug with a contact section having a cross-sectional area of a polygon wherein the cutting edges extend parallel to the longitudinal axis of the contact element.

When the electrical connection arrangement is designed in accordance with the present invention, it has the advantage that it is possible to make contact, with the capability of satisfactory automation, between, above all, relatively thin wires whose inherent stability is insufficient to resist deformation of their cross section.

For this purpose, the connection arrangement has a receptacle for a connecting wire and a contact element, it being possible to assemble these to an end position by a simple plugging movement which can be readily automated. In this case, the connecting wire is cut at least in partial regions by the contact element, with the formation of a cutting connection, and makes reliable contact with said contact element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
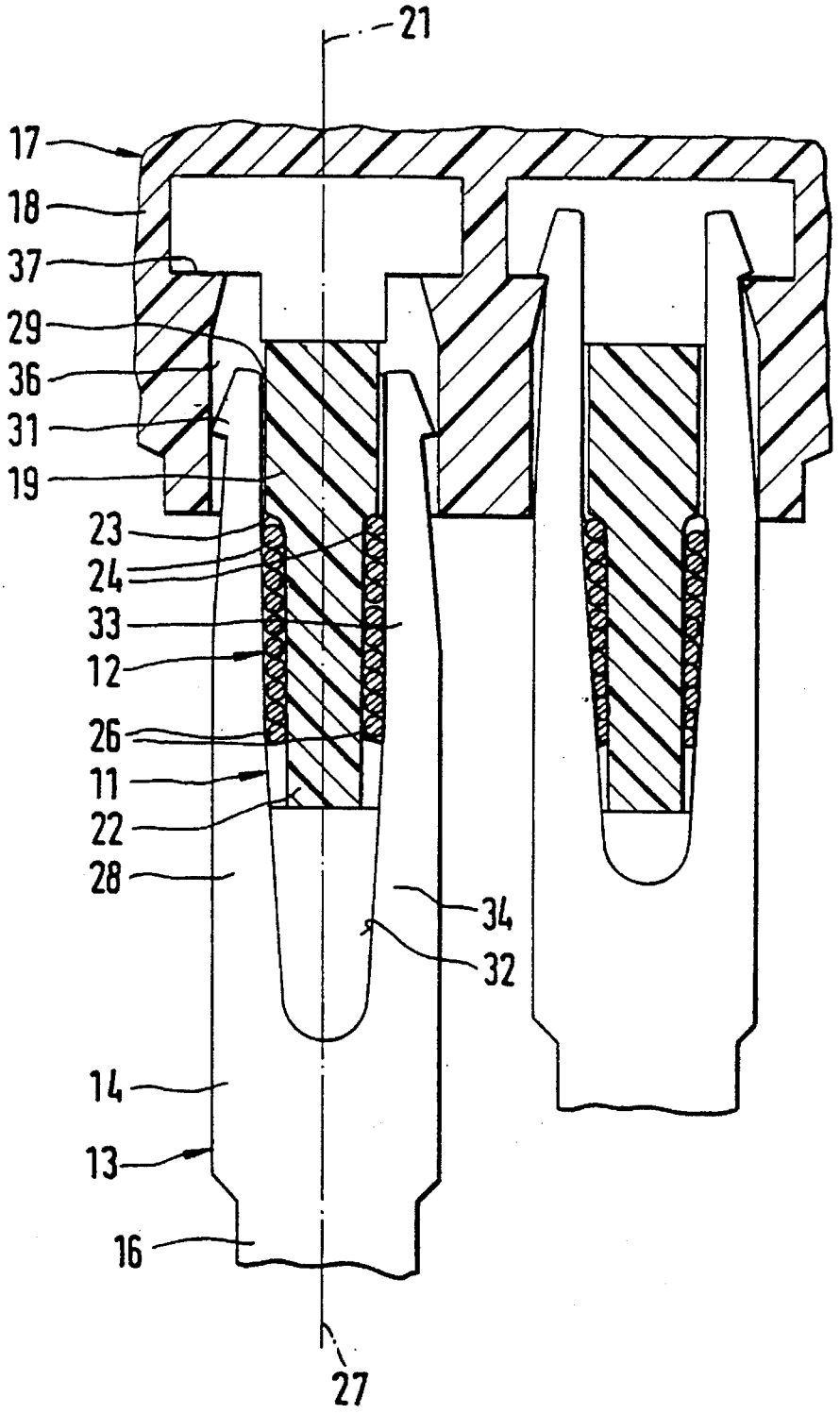
FIG. 1 is a view showing a longitudinal section of a first embodiment of an electrical connection arrangement in accordance with the present invention in a preassembly position and in an end position.

A first exemplary embodiment of an electrical connection arrangement is illustrated in FIG. 1. Said arrangement has, as main components, a receptacle 11 for a connecting wire 12 and a contact element 13, which can be connected to the connecting wire 12 via a connecting part 14 and can be releasably coupled to a mating plug (no longer illustrated) via a plug part 16.

The receptacle 11 is part of a housing 17 for a coil. The housing 17 made of plastic has the form of a coil former, which has at the ends a flange 18 in each case, for the purpose of delimiting the winding space. One radially directed receptacle 11 for each of the two ends of the coil emerges in each case from one of the flanges 18.

The receptacle 11 is bound to the flange 18 as a connecting hook having a holding section which is rectangular in cross section. The holding section 19 is adjoined by a winding section 22 having a smaller cross-sectional area., which is constant in the longitudinal extent, and arranged symmetrically with respect to a longitudinal axis 21 of the receptacle 11, a radially extending shoulder 23, which points away from the coil, being formed at the transition of the winding section 22 to the holding section 19. The connecting wire 12 is wound as a winding, in a single layer having a plurality of turns, onto the winding section 22 in a fixed manner and with no radial play, a start turn 24 bearing against the shoulder 23 and an end turn 26 being fixed in a slot (no longer illustrated) close to the exposed end of the winding section 22. The shoulder 23 is dimensioned in such a way that it covers the connecting wire 12 of the start turn 24 approximately up to 0.7 of the diameter of said wire, and forms a stop for the axial securing of the turns, fitted to the winding section 22, of the connecting wire 12. The connecting wire 12 itself is a thin winding wire without any appreciable inherent stability and with a layer of varnish as insulation.

The contact element 13 is designed as a forked, metal flat-pin plug with two elongate limbs 28 adjoining the contact part and arranged symmetrically with respect to a longitudinal axis 27 of the contact element 13. Said limbs have a contact opening 29 between their free ends and have wedge-shaped locking hooks 31 on the outside.

The opposite inner sides of the limbs 28 extend parallel to one another, at a radial separation corresponding to the diameter of the connecting wire 12 arranged on the winding section 22, in an insertion section 33 which is formed approximately over half the longitudinal extent of the limbs 28 and starts from the contact opening 29. In a contact section 34, which adjoins the insertion section 33 and reaches the plug part 16, the inner sides of the limbs are designed as cutting edges 32 and are inclined with respect to the longitudinal axis 27 of the contact element 13 in such a way that their radial separation becomes continuously smaller in the direction of the plug part 16, until at the end it is slightly larger than the width of the winding section 22 when the latter has no wire wound around it.

To produce the connection arrangement, the contact element 13 must be plugged by its limbs 28 onto the receptacle 11 provided with the connecting wire 12. For this purpose, the contact element 13 is oriented in such a way that its longitudinal axis 27 is aligned with the longitudinal axis 21 of the receptacle 11.

In the left-hand part of FIG. 1, the contact element 13 is in a preassembly position, in which it is pushed so far onto the receptacle 11 that the point of transition between the insertion section 33 and the contact section 34 is situated at the end turn 26. In this case, the locking hooks 31 are plunged into a guide channel 36, which is arranged in the flange 18 and extends symmetrically with respect to the longitudinal axis 21 of the receptacle 11, and are bearing against the wall of said guide channel.

When the contact element 13 is plugged further onto the receptacle 11 provided with the connecting wire 12, the cutting edges 32 come into contact with the turns of the connecting wire 12 and, owing to their higher strength and as a result of their inclination with respect to the longitudinal axis 27, they cut into the turns of the connecting wire winding. In the process, the insulation of the connecting wire 12 is cut through and said connecting wire makes electrical contact with the contact element 13. Spreading and deflection of the limbs 28 are prevented due to their guidance by means of the locking hooks 31 and parts of the insertion section 33 in the guide channel 36, and deflection of the thin, weak connecting wire 12 is prevented due to its support on the receptacle 11. The winding of the connecting wire is secured against displacement in the axial direction due to the shoulder which points counter to the plugging direction of the contact element 13.

At the end of the guide channel 36, which is radially constricted before this region, the locking hooks 31 snap on behind complementary locking shoulders 37 and lock the connection arrangement in the end position, as illustrated in the right-hand half of FIG. 1.

In the end position, as a result of the inclination of the cutting edges 32 with respect to the longitudinal axis 27 of the contact element 13, on the one hand, and due to the turns, arranged parallel to the longitudinal axis 21 of the receptacle 11, of the connecting wire 12, the end winding is cut and makes electrical contact to the greatest degree, the subsequent winding to an increasingly lesser degree and the start winding 24, finally, is cut and makes electrical contact slightly or even not at all. It is thus achieved that in the course of the turns from the end turn 26 to the start turn 24 the deformation of the connecting wire 12 by the contact element 13 becomes smaller and smaller and hence the risk of the connecting wire 12 breaking decreases in the direction of the start turn 24 and hence in the direction of the coil.

The more turns there are on the winding section 22, the larger is the contact area between the contact element 13 and the connecting wire 12, with appropriately selected inclination of the cutting edges 32 with respect to the longitudinal axis, two partial contact areas arising for each cut turn in this exemplary embodiment.

In this arrangement, the cross section of the winding section is preferably oval or rectangular with rounded narrow sides, in order to provide support for the connecting wire in the region of the longitudinal sides against the cutting edges which act there. In principle, this type of contact-making is possible even with one cutting edge.

Figure 2:
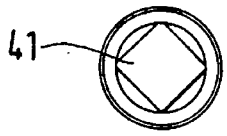
FIG. 2 is a view showing a cross-section of the electrical connection arrangement in accordance with a second embodiment of the present invention.

In the second exemplary embodiment, the contact element 13 according to FIG. 2 is designed as a circular plug. The contact section 34 thereof is designed as a prismatic square 41 with longitudinal edges which form the cutting edges 32. As an alternative, the contact section 34 can also be designed as a prism with a cross-sectional area of another polygon.

Figure 3:
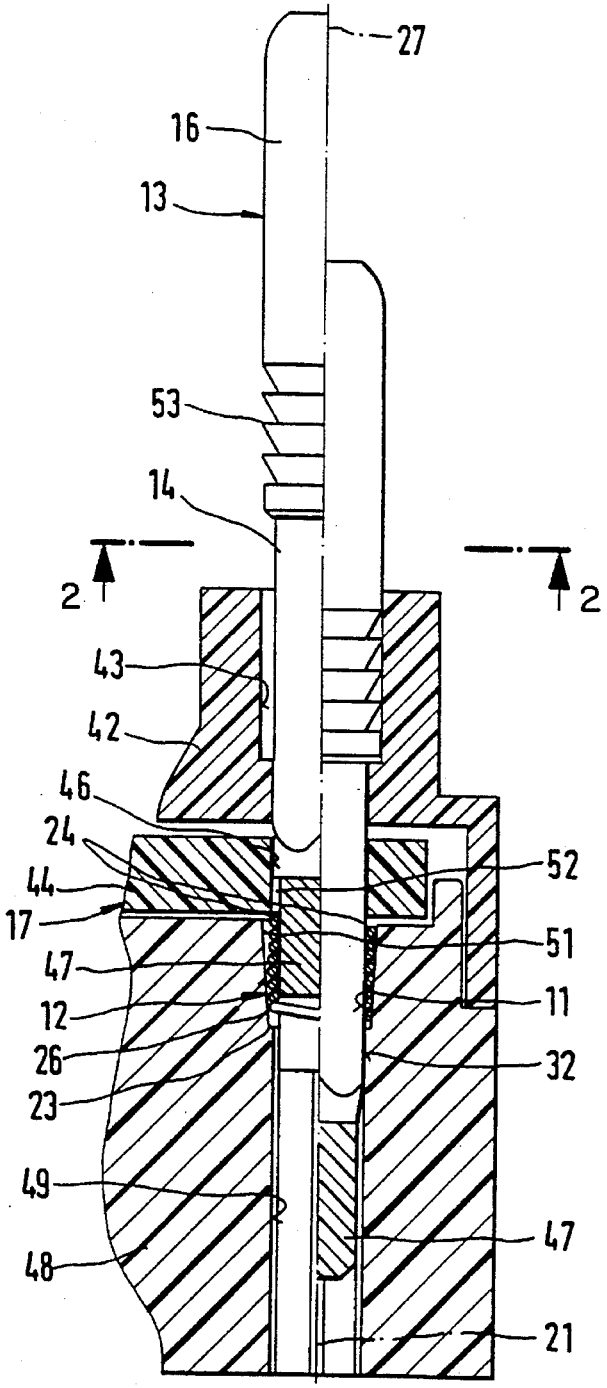
FIG. 3 is a view showing a longitudinal section of the electrical connection arrangement of the second embodiment shown in FIG. 2.

The contact element 13 is supported according to FIG. 3 in an insulating housing 42, which is arranged above the housing 17 of the coil and protects the latter. The contact element 13 can be displaced along its longitudinal axis 27 in a guide hole 43 in the insulating housing 42. The following are arranged in alignment with the guide hole 43: a blind hole 46 in a wall 44 of the housing 17, a pin 47, which issues from the wall 44, and, 10 in a lower part 48, which is situated underneath the housing 17, is made of insulating material or plastic and on which the coil is fixed, the receptacle 11 and a passage hole 49.

Whereas the passage hole 49 is dimensioned in such a way that it can accommodate the pin 47 with movement play and the square 41 with a press fit, the receptacle 11 is designed as a conical hole, constricting toward the passage hole 49, with an inner wall 51. The receptacle 11, which has, over its entire longitudinal extent, a larger radial dimension than the passage hole 49, adjoins the latter with the shoulder 23, which is dimensioned as in the first exemplary embodiment.

The connecting wire 12 is fitted to the pin 47 in one layer with a plurality of turns, the start turn 24 bearing against the wall 44 of the housing 17 and the end turn 26 being fixed close to the exposed end of the pin 47.

The pin 47 is connected to the rest of the housing 17 via four thin webs 52 which are distributed uniformly over the periphery of said pin and are designed as desired breaking points.

If the contact element 13 is guided from a preassembly position, according to the left-hand half of FIG. 3, toward the pin 47, then the webs 52 break under a severe pressure load and the pin 47 is pushed past the shoulder 23 into the passage hole 49. During this movement, the end turn 26 comes to bear against the shoulder 23 which forms an axial stop for the turns of the connecting wire 12. In the event of continued movement, all the turns of the thin, weak connecting wire 12 are stripped off from the pin 47, pressed against the inner wall 51 of the receptacle 11 by the square 41 and radially supported there. The angle of inclination of the inner wall 51 with respect to the longitudinal axis 21 of the receptacle 11 and the respective radial extent, which has changed over the longitudinal extent, of the receptacle 11 are dimensioned in such a way that when the square 41 reaches the end position according to the right-hand half of FIG. 3, it cuts, by means of the four cutting edges 32, and makes contact with the end turn 26 to the greatest degree and the start turn 24 only slightly or not at all.

Consequently, as in the first exemplary embodiment, the connecting wire 12 is mechanically loaded only slightly toward the coil and any risk of breaking on the coil is avoided.

Compared with the first exemplary embodiment, the contact area between the contact element 13 and the connecting wire 12 is doubled in this embodiment, since the cutting edges 32 form four contact areas for each cut turn.

The end position of the connection arrangement is secured by a press fit of the contact section 34 in the passage hole 49 or by radially directed sealing ribs 53 which are fitted to the connecting part 14 and are introduced into the guide hole 43, with a press fit, in the end position.

A common feature of both exemplary embodiments is the fact that contact can be made easily, using a procedure which can be carried out in a joint operation and can be automated, between the contact elements 13 and the thin connecting wires 12, which have no appreciable inherent stability, due to the configuration of the two receptacles 11 for radially supporting the connecting wires 12 of the two winding ends of the coil and of the assigned contact elements 13, and that it is possible to achieve reliable contact-making due to the large contact areas.

It will be understood that each of the elements described above, or two or more together, may also find a useful application in other types of constructions differing from the types described above.

While the invention has been illustrated and described as embodied in an electrical connection arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electrical connection arrangement, comprising a connecting wire; a receptacle for retaining said connecting wire; a contact element for connecting to said connecting wire and for detachably coupling to a mating plug, said connecting wire being arranged in form of a winding having a plurality of turns so as to bear against said receptacle, said contact element having at least one cutting edge extending in a longitudinal direction of said winding, said cutting edge and a delimitation of said winding opposite to said cutting edge being inclined relative to one another in the longitudinal direction of said winding so that in the event of a plugging movement of said contact element onto or into said receptacle, said cutting edges enter into a cutting connection with at least one of said turns of said connecting wire which is radially supported on said delimitation, said receptacle and said contact element having aligned longitudinal axes so that the plugging movement of said contact element onto or into said receptacle provided with said connecting wire takes place as far as an end position in which said contact element and said receptacle are fixed relative to one another; means for fixing said contact element an said receptacle with one another, said receptacle being formed as a connecting element of a coil with a winding section carrying said connecting wire in one layer and a cross-sectional area which is essentially constant in direction of a longitudinal axis of said receptacle, said contact element being formed as a flat-pin plug having two limbs with inner sides provided with cutting edges formed in a contact section, said cutting edges being inclined relative to the longitudinal axis of said contact element.

2. An electrical connection arrangement as defined in claim 1, wherein said receptacle has a shoulder pointing counter to the plugging direction of said contact element and arranged so that said winding bears against said shoulder.

3. An electrical connection arrangement as defined in claim 1, wherein said fixing means include complementary locking elements.

4. An electrical connection arrangement as defined in claim 1, wherein said fixing means include a press fit.

5. An electrical connection arrangement, comprising a connecting wire; a receptacle for retaining said connecting wire; a contact element for connecting to said connecting wire and for detachably coupling to a mating plug, said connecting wire being arranged in form of a winding having a plurality of turns so as to bear against said receptacle, said contact element having at least one cutting edge extending in a longitudinal direction of said winding, said cutting edge and a delimitation of said winding opposite to said cutting edge being inclined relative to one another in the longitudinal direction of said winding so that in the event of a plugging movement of said contact element onto or into said receptacle, said cutting edges enter into a cutting connection with at least one of said turns of said connecting wire which is radially supported on said delimitation, said receptacle and said contact element having aligned longitudinal axes so that the plugging movement of said contact element onto or into said receptacle provided with said connecting wire takes place as far as an end position in which said contact element and said receptacle are fixed relative to one another; means for fixing said contact element an said receptacle with one another, said receptacle being formed as a conical hole, said contact element being formed as a circular plug with a contact section having a cross-sectional area of a polygon with cutting edges extending parallel to a longitudinal axis of said contact element.

6. An electrical connection arrangement as defined in claim 5, wherein said receptacle has a shoulder pointing counter to the plugging direction of said contact element and arranged so that said winding bears against said shoulder.

7. An electrical connection arrangement as defined in claim 5, wherein said fixing means include complementary locking elements.

8. An electrical connection arrangement as defined in claim 5, wherein said fixing means include a press fit.

* * * * *